US006431894B1

(12) United States Patent
Boiret et al.

(10) Patent No.: US 6,431,894 B1
(45) Date of Patent: Aug. 13, 2002

(54) CONNECTOR HAVING SHUNTABLE AND CONFIGURABLE CONTACTS

(75) Inventors: Gerard Boiret, Yvre l'Eveque; Christophe Provost, Cherre, both of (FR)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/691,431

(22) Filed: Oct. 18, 2000

(30) Foreign Application Priority Data

Oct. 19, 1999 (FR) ..... 99 12997

(51) Int. Cl.[7] ..... H01R 29/00
(52) U.S. Cl. ..... 439/189; 200/51 R; 200/252
(58) Field of Search ..... 439/488, 169, 439/352, 188, 171, 43, 13; 200/51 R, 51.02–51.03, 51.05–51.06, 252

(56) References Cited

U.S. PATENT DOCUMENTS 3,739,231 A * 6/1973 Luteran ..... 361/805
3,760,329 A * 9/1973 Stepan ..... 439/46
4,042,795 A * 8/1977 Sycora ..... 200/16 D
4,341,935 A * 7/1982 Josemens ..... 200/252
4,676,568 A 6/1987 Nault et al. ..... 439/169
4,701,134 A 10/1987 Jones ..... 439/43
4,737,602 A * 4/1988 Yamamoto ..... 200/16 D
5,096,431 A 3/1992 Byrne ..... 439/171
5,266,043 A * 11/1993 Giroux et al. ..... 439/188
5,544,004 A * 8/1996 Inagaki et al. ..... 361/633
5,667,062 A * 9/1997 Yasufuku et al. ..... 200/536

FOREIGN PATENT DOCUMENTS

EP 0576365 A1 12/1993

* cited by examiner

*Primary Examiner*—P. Austin Bradley
*Assistant Examiner*—Larisa Tsukerman
(74) *Attorney, Agent, or Firm*—Perman & Green, LLP

(57) ABSTRACT

A connector (1) provided with at least one power contact (10) for powering at least one contact to be powered (11), situated in the proximity of the power contact, through a socket (18) sliding along the contact to be powered to establish or not a conductive connection with a conductive surface (17) of the power contact. such a connector typically comprises several contacts to be powered and several power contacts. Hence, an equilateral and equidistant arrangement of contacts to be powered around power contacts is preferred.

12 Claims, 3 Drawing Sheets

CONNECTOR HAVING SHUNTABLE AND CONFIGURABLE CONTACTS

BACKGROUND OF THE INVENTION

1. Field of the Invention

The present invention relates to a connector having shuntable and configurable contacts. More particularly, the invention finds use in the field of "shunt" connectors, to allow connectors to selectively interconnect fixed tracks of a printed board integrated in the connector. These connectors have contacts, for instance connected to individual tracks of a printed board, which contacts may be selectively connected with each other to provide connection between fixed tracks. The invention particularly is particularly suitable for connectors used in aeronautic applications, particularly is on aircraft engines. A connector according to the invention has the advantage that it can be used in difficult external conditions, particularly at high temperature (of the order of 150° C.).

2. Description of Prior Developments

In prior art, connectors are known which have contacts, typically fitted on printed boards. A printed board has fixed tracks typically engraved in a board substrate. In order to connect two tracks together when desired, if the pattern of the printed board does not allow to do so, each track has to be provided, at a desired point, with a contact and connection has to be ensured between these contacts. For instance, a prior art connector is known which has such contacts that first ends of these contacts may, for example, be in contact each with a track of the printed board, and that second ends of these contacts are free on a rear surface of the connector.

In prior art, two free ends of contacts disposed within the same connector are interconnected, shorted, by using a conductive element to be put in contact with the two contacts. Particularly, in document EP-A-0 576 365, a connector is known which has conductors, so that each conductor may be put in contact with another by means of a U-shaped bar. U-shaped bars are typically disposed in a cover to be fitted on the connector. Depending on the arrangement of the bars, short circuits between conductors can be obtained or prevented. Hence, the number of covers to be provided shall correspond to the possible combinations of connections between conductors. Each cover provides a specific lay-out of U-shaped bars.

From the principle of document EP-A-0 576 365, covers are also known which have conductive elements, so that these conductive elements are put or not in contact with each other, as a function of the height of a wall separating two adjacent conductive elements. In this document, the provided configuration of short circuits is defined by the respective heights of the cover walls. Hence, the number of covers to be provided, with different wall height arrangements shall correspond to the possible combinations of connections between conductors.

This solution involves a problem. While it has an easy implementation, the different covers being easily mounted, it involves at each new configuration, the complex process; of removing the cover, detaching the conductive elements therefrom, disposing them in a new appropriate cover, and fitting this new cover on the connector. This solution involves many individual elements, which may get lost during a configuration change of the connector and of connections.

SUMMARY OF THE INVENTION

The invention has the object to obviate the above problems by providing a connector which has configurable contacts. The solution proposed by the invention provides a connector which has conductive means for shorting the different contacts together. The interest of the invention lies in that it provides a system which allows to displace these conductive means between a first position in which they are in contact, and a second position in which they are not in contact. To this end, a connector according to the invention includes power contacts having, at different heights, an insulating surface and a conductive surface.

Also, the connector includes contacts to be powered, each provided with a sliding and conductive socket to come or not into contact with an insulating surface, or with a conductive surface of a power contact of the connector. The invention also allows to connect a is power contact with several contacts to be powered. Further, a contact to be powered may be selectively put in contact with a power contact independently of the connections established between this power contact and other contacts to be powered. This allows to change one connection only, without having to reestablish all the others.

Furthermore, a connector according to the invention may also be configurable to be adapted to different types of complementary connectors. Depending oh the position of sockets along contact axes, a contact has a more or less long contact end to be connected with a complementary contact of a complementary connector. In fact, the sliding socket is movable between a high position and a low position. In the high position, it completely hides the contact along which it slides. In said high position, it is mechanically joined to the insulating portion of the power contact. Thereby, the contact is inaccessible to connection with a complementary connector, and it is not powered. Conversely, in the low position, the socket exposes a free contact end. The free contact end may be connected with a complementary connector. Also, in this low position, the socket ensures connection with a conductive portion of the power contact.

Finally, the shape of sockets is such as to allow them to interlock mechanically with projections of the insulating or conductive surfaces of power contacts. These interlocks help to retain the configurable connections. The conductive and insulating surfaces of power contacts may be obtained by crimping sleeves thereon, i.e. plugging them in with a much higher force than by manual insertion.

Hence, the invention relates to a connector which has a body, at least one power contact and at least one contact to be powered, each of the contacts having a first end fitted in the body, characterized in that the is power contact has an insulating surface and a conductive surface, and in that the contact to be powered has a conductive socket, sliding along the contact to be powered, between a first position in which the socket is in contact with the insulating surface, and a second position in which the socket ensures connection with the conductive surface, so that the connection obtained in the second position is conductive and allows powering of the contact to be powered by the power contact.

BRIEF DESCRIPTION OF THE DRAWINGS

The invention will be understood more clearly by reading the following description and by analyzing the accompanying figures. The latter are only shown by way of example and do not intend to limit the invention in any manner. The figures show.

DESCRIPTION OF THE PREFERRED EMBODIMENTS

Figure 1:
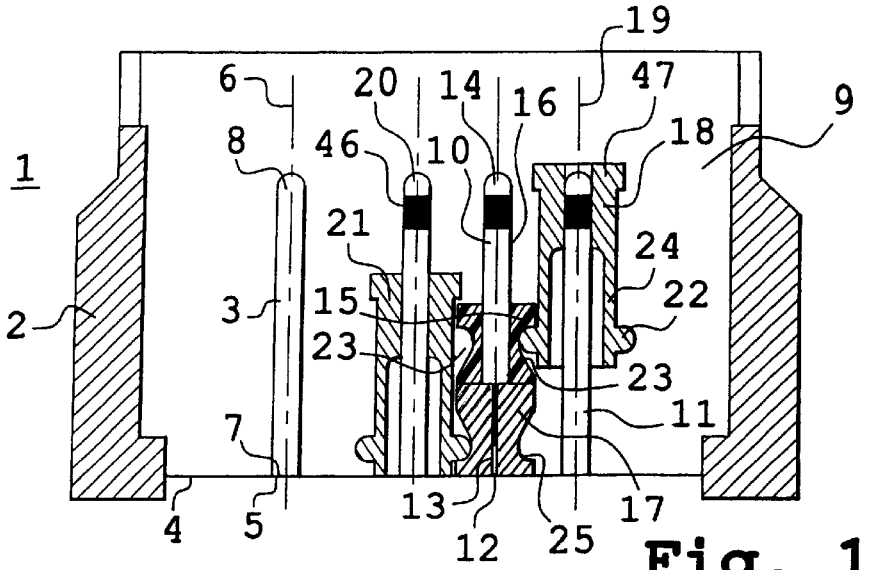
FIG. 1: a sectional view of a first embodiment of a connector according to the invention.

FIG. 1 shows a connector 1 according to the invention. The connector 1 comprises a body 2, wherein contacts are disposed. A contact 3 is mounted in a rear insulator 4 of the body 2. The rear insulator 4 has a receiving hole 5 for accommodating the contact 3. As a whole, the contact 3 has a shape elongating along an axis 6. The axis 6 is preferably orthogonal to a plane formed by the rear insulator 4. The contact 3 has a first end 7 and a second free end 8, the first end 7 being inserted in the hole 5. The contact 3 is disposed inside the body 2 so that a portion of the contact 3 protrudes in a cavity 9 of the body 2. A depth of this cavity 9 is preferably greater than a length of the protruding portion of the contact 3. Therefore, the end 8 of the contact 3 does not project out of the body 2. By its end 7, the contact 3 may be connected to a track of a printed board, particularly by soldering.

The connector 1 comprises a power contact 10 and a contact to be powered 11. The contacts 10 and 11 are of the same type as the contact 3. The contact to be powered 11 is situated in the proximity, in the immediate vicinity of the power contact 10. Here, immediate vicinity means that no contact is interposed between two adjacent contacts. The power contact 10 is fitted in a receiving hole 12 of the rear insulator 4. The power contact 10 has an end 13, like the end 7, and an end 14, like the end 8. The end 13 is fitted in the hole 12. This end 13 is connected to a power source (not shown) or to a track of a printed board (not shown) whereon the connector is fitted.

The end 14 is free inside the cavity 9. In a preferred embodiment of a connector according to the invention, the power contact 10 is selectively connected, or not, with one or more contacts to be powered. For this purpose, the contact 10 has an insulating surface 15. In a preferred embodiment of the invention, the insulating surface 15 is obtained by fitting an insulating sleeve around the power contact 10.

The insulating surface 15 is situated between the ends 13 and 14, so that a first conductive surface 16 may be defined, in the upper portion, between the insulating surface 15 and the end 14, and that a second conductive surface 17 may be defined in the lower portion between the insulating surface 15 and the end 13. In this preferred embodiment, the conductive surface 17 (i.e. the second conductive surface) is obtained by fitting a sleeve around the power contact 10. For instance, the conductive sleeve 17 may have a symmetrically inverted shape with respect to that of the insulating surface 15 in the form of a sleeve 15. Then, the sleeves 15 and 17 are crimped around the power contact 10. They may preferably be force-fitted around the contact. Typically, the conductive sleeve 17 abuts against the rear insulator 4. The respective positions of the sleeves 15 and 17 may as well be inverted.

In one variant, the free end 14 of the power contact 10 may be arranged to be connected to a complementary contact of a complementary connector.

The contact to be powered 11 has a socket 18 sliding along a protruding part of the contact to be powered 11. The socket 18 slides along an axis 19 of the contact to be powered 11, such as the axis 6. The contact to be powered 11 is shown with the socket 18 in the high position. Another contact to be powered 20, like the contact to be powered 11, has a socket 21, like the socket 18. The contact to be powered 20 is shown with the socket 21 the low position.

The socket 18 may ensure conductive connection between the contact to be powered 11 and the power contact 10. In a first embodiment, shown in FIG. 1, the socket 18 is made of a conductive material ensuring, on the one hand, electric connection with the contact to be powered 11. The socket 18 is mounted in contact with the contact to be powered 11. on the other hand, in order to ensure conductive connection with the power contact 10, the socket 18 has a projection 22 to come in contact with the power contact 10. This projection 22 is, for instance, a shoulder on the periphery of the socket 18.

Depending on the position of the socket 18 along the axis 19, the projection 22 rests against different portions of the power contact 10. Particularly, in a high position, the projection 22 rests against the insulating surface 15 of the power contact 10. In a low position, the projection 22 comes in contact with the conductive surface 17 of the power contact 10.

In the first embodiment, as shown in FIG. 1, the insulating surface 15 is a cylindrical sleeve fitted around the power contact 10. It particularly has an undercut 23. This undercut 23 is adapted to receive and retain the projection 22. In this embodiment, the projection 22 is formed on a tongue 24 of the socket 18. The latter may consist of a tube having at least two slits. Thus, when the socket 18 passes from the high position to the low position, the tongue 24 is slightly deflected so that the projection 22 may slide along an outer wall of the insulating sleeve 15. Then, when the socket 18 reaches its low position, the projection 22 is released and engages in the first undercut 23 or in the second complementary undercut 25 of the conductive sleeve 17. The projections might be inverted: they may be provided in the sleeves of the power contact, whereas undercuts may be provided in the socket of the contact to be powered.

Figure 2:
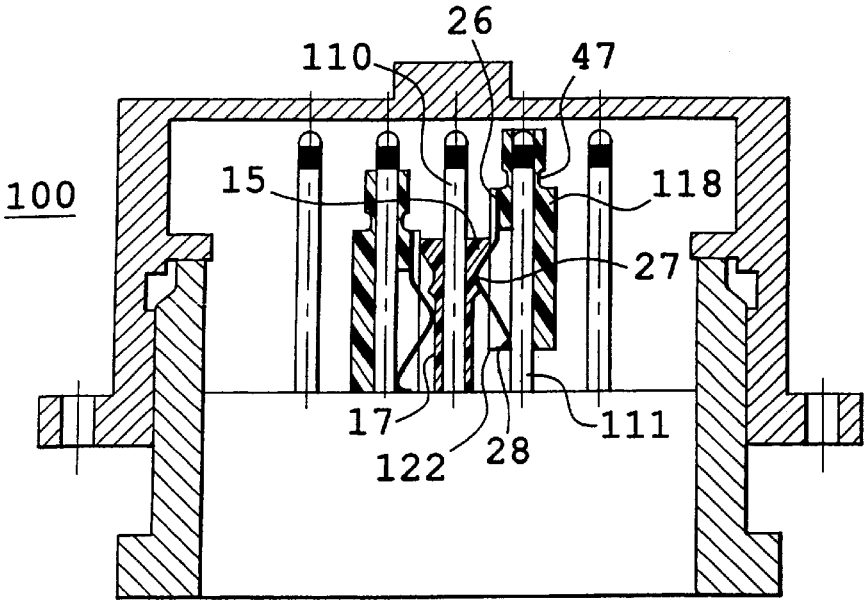
FIG. 2: a sectional view of a second embodiment of a connector according to the invention.

A second embodiment of a connector according to the invention is shown in FIG. 2. A connector 100 has a contact to be powered 111, surrounded by a socket 118 to come into contact with a power contact 110. In this embodiment, the socket 118 is made of an insulating material.

In order to ensure conductive connection between the contact to be powered 111 and the power contact 110, the socket 118 has a conductive blade 122. This conductive blade 122 is fitted in the insulating body of the socket 118 in such a manner that it has a first bend 27 to come into contact with the power contact 110, particularly in undercuts thereof, and a second bend 28 to come into contact with the contact to be powered 111. As hereinbefore, in this embodiment the insulating surface is an insulating sleeve 15 fitted around the power contact 110. This sleeve 15 has a complementary undercut for holding the bend 27 therein. A conductive is surface is adjacent to the insulating surface 15, and consists of a conductive sleeve 17. The bend 28 comes in direct contact with the contact to be powered 111, whereby it is in permanent contact therewith, whereas the bend 27 is alternatively in contact with the insulating sleeve 15 or with the conductive sleeve 17. As a variant, the sleeve 15 or 17 is conductive, but the depth of the undercuts is such that it can push or not the bend 28 against the contact to be powered 111. A connector cap may be also provided to protect the connector from dirt or short-circuit risks.

In one variant, there might be provided a power contact 10 which is encircled, over a limited height only, by a circular insulating layer which is situated at half height between the two ends 13 and 14. In such an embodiment, a conductive connection ensured by a socket surrounding a contact to be powered would be achieved by direct contact with the power contact 10 whereas insulation would be achieved by contact with the insulating layer. Nevertheless, in this case, no mechanical restraint would be possible.

Typically, the connector 1 comprises several contacts to be powered 11 arranged around several power contacts 10. A preferred embodiment of this type of connector consists in minimizing the number of power contacts 10 and maximizing the number of contacts to be powered 11. Hence, advantages are obtained from an optimized arrangement of contacts to be powered around power contacts. Thus, a geometrical arrangement of contacts to be powered 11 around power contacts 10 is preferred. Particularly, in a preferred embodiment, a set of contacts to be powered is disposed in such a manner that each contact to be powered is at the same distance from the central power contact designed to power said set of contacts to be powered. Further, in order to minimize the space required by contacts to be powered around the power contact, contacts to be powered are disposed equilaterally around said central power contact.

Figure 3:
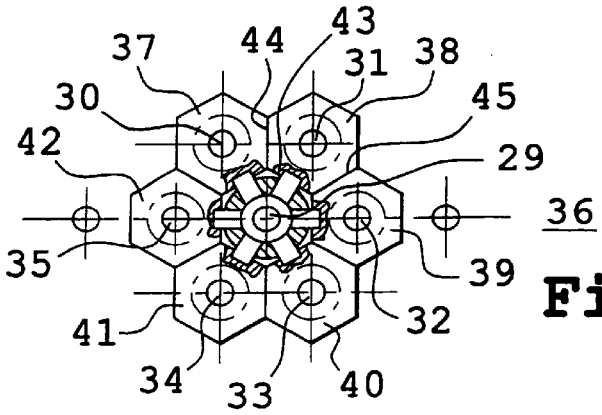
FIG. 3: a top partial view of a connector according to the invention.

In a preferred embodiment, as shown in FIG. 3, a power contact 29, like the power contact 10, is surrounded by six contacts to be powered 30–35, like the contact to be powered 11. These contacts to be powered 30–35 form a set 36. Each of these contacts to be powered 30–35 is encircled by its respective socket 37–42.

If the sockets are of the same type as the ones of FIG. 2, i.e. insulating sockets, these sockets 37–42 have a hexagonal section. Thus, a face 43 of a socket 38 comes to rest against a portion of the power contact 29.

Two faces 44 and 45, adjacent to the face 43 come into contact with the adjacent faces of the sockets 37 and 39 respectively. The sockets of the set 36 have identical shapes and are disposed in the same manner relative to the contact of the power contact 29.

In this embodiment a center distance between an axis of a power contact and an axis of a contact to be powered is of the order of 3 millimeters. Also, a diameter of a power contact or of a contact to be powered is of the order of 1 millimeter. A power contact is typically surrounded by a maximum of six contacts to be powered. In fact, it is difficult to provide sockets with a smaller inside diameter to come in contact with a closer power contact.

In this embodiment of a hexagonal socket, a honeycomb arrangement of sockets, and of contacts, is achieved. This arrangement allows the contacts to be assembled together with no interstices therebetween. Furthermore, if a stress is exerted on an edge of a contact, then the structure of the whole set of contacts joined together remains unchanged. The hexagonal arrangement of six contacts to be powered around a central power contact ensures a high contact positioning and retaining accuracy.

In the variant, this arrangement also allows to ensure a better exposure of contacts for connection with a complementary connector.

The contacts disposed in the connector 1 according to the invention also have a guiding mark 46, typically situated in a portion of the contact in the proximity of the free end, like the end 8. The power contact 10 also has a guiding mark in this free portion. The interest in providing such a mark 46 lies in that it allows to visually identify powered contacts in a quick and easy manner. In fact, when the socket 18 is in the high position, the mark 46 is invisible, as it is hidden by the socket. Conversely, when the socket 18 is in the low position, the mark 46 is visible. This mark may be a color chip.

Hence, a connector according to the invention may be configured as desired. Each contact to be powered may be set either in a powered state or in an non-powered state relative to a power contact, with no effect of this selection on powering of the adjacent contacts to be powered, nor on powering of contacts in general. The sockets of each contact to be powered are easily displaced in an individual and independent manner. Each socket has a gripping area 47, allowing it to be gripped, for instance by hand, to move the sockets into a selected position. In one preferred embodiment, sockets, like 18, 21 or 118 may be displaced manually. This manual displacement does not hinder in any manner position lock, thanks to the presence of protrusions and undercuts.

Figure 4:
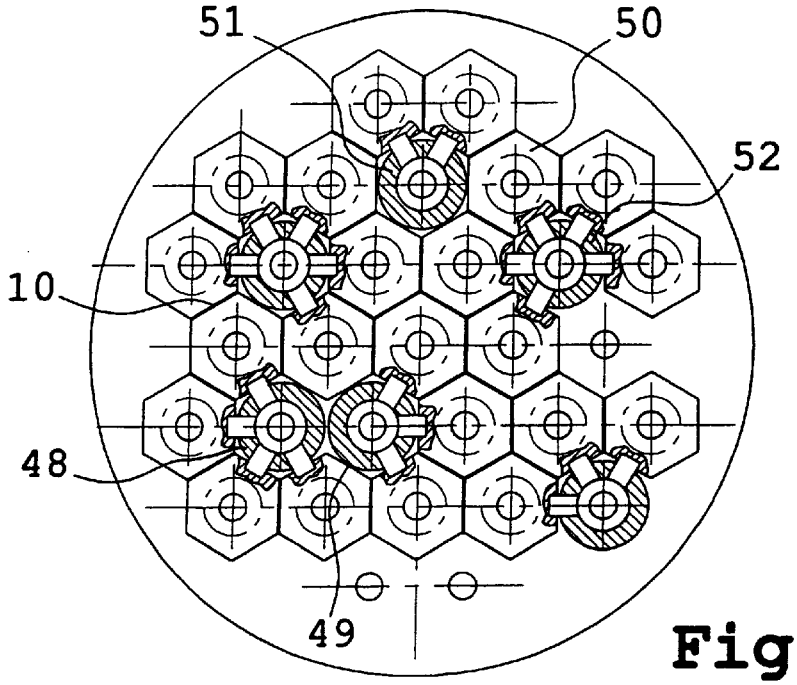
FIG. 4: a top view of a connector according to the invention.

FIG. 4 shows a connector having six power contacts like the contact 10. These contacts are represented in gray. In this embodiment, each power contact is surrounded by a maximum of six contacts to be powered. In fact, two power contacts, like the contacts 48 and 49 may be adjacent, but in this case these two power contacts 48 and 49 are not electrically interconnected. Power contacts have the function of relays for connecting together distant contacts to be powered. As a rule, a contact to be powered is in contact with one power contact only. Nevertheless, a contact to be powered 50, situated between two power contacts 51 and 52 might be arranged to be connected either alternatively or simultaneously with two contacts to be powered 51 and 52. In this case, a socket encircling said contact to be powered 50 would have two flexible conductive tongues (not shown).

Figure 5:
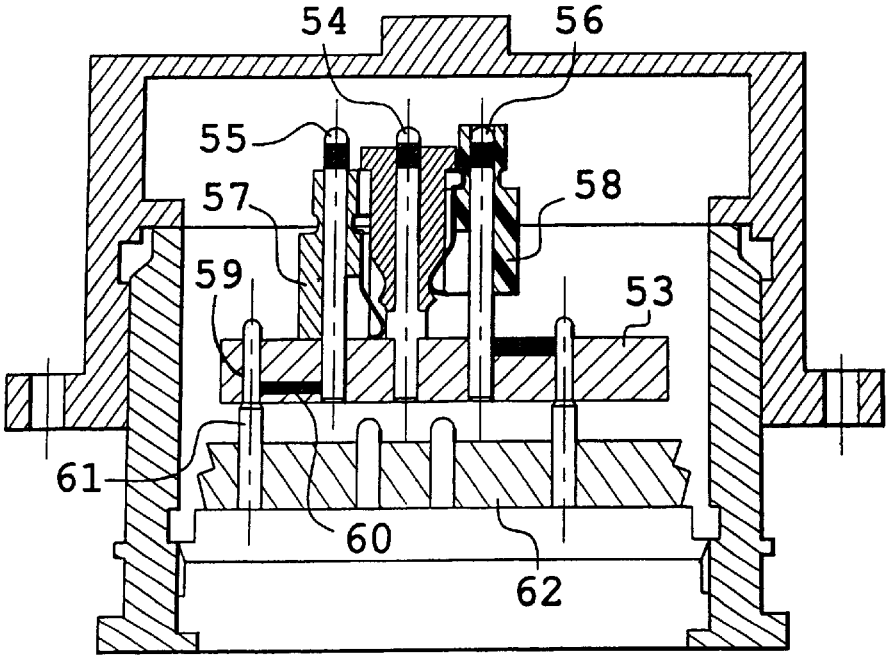
FIG. 5: a sectional view of an improvement of a connector according to the invention.

In an improvement of the invention, configurable contacts may be provided for connectors having different center distances between contacts of a connector. In a first case, there may be provided sockets having conductive blades which may come from the contact of a power contact more or less distant from the contact around which the socket is fitted. In a second case, as shown in FIG. 5, a printed board 53 is provided having, for instance, a power contact 54 and two contacts to be powered 55 and 56 on both sides of the power contact 54. The contacts to be powered 55 and 56 are provided with the sockets 57, 58 respectively, like the socket 18. Further, the printed board 53 has a hole 59 so that this hole 59 is connected to the contact to be powered 55 by conductive track 60 of the printed board 53. This track 60 may be situated on one of the two surfaces of the printed board 53.

The interest of this improvement shown in FIG. 5 lies in that it allows reception of a contact 61 of a second printed board 62 into the hole 59. Holes like the hole 59 of the printed board 53 may have a random arrangement, because these holes are then connected to the contacts 54, 55 and/or 56 so that the arrangement of these contacts corresponds to the hexagonal arrangement as shown in the other figures. This allows selective connection of contacts disposed on a second printed board 62 in which center distances between contacts are not equally distributed.

Typically, the printed board 53 is of the multilayer type, to provide as many tracks as possible between holes like the hole 59 and contacts like the contacts 54, 55 and 66. In FIG.

6, a printed board 63, like the printed board 53 has four groups of contacts. Each group of contacts includes a power contact and at least one contact to be powered. For instance, the printed board 63 includes a first group 64, including a power contact 65 and three contacts to be powered 66, 67 and 68 respectively. Furthermore, the printed board 63 includes a second group 69, so that the contacts of these group 69 are not adjacent to the contacts of the group 64.

Figure 6A:
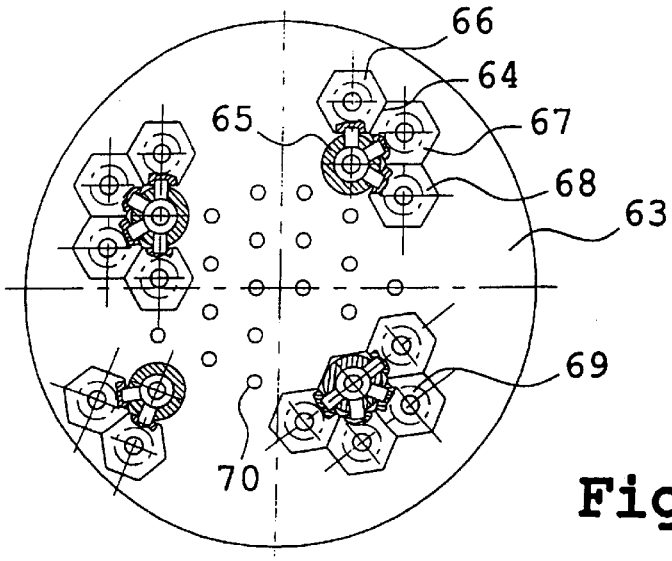
FIGS. 6A, 6B, and 6C are top views of three different levels of an embodiment of a connector according to the invention.
Figure 6B:
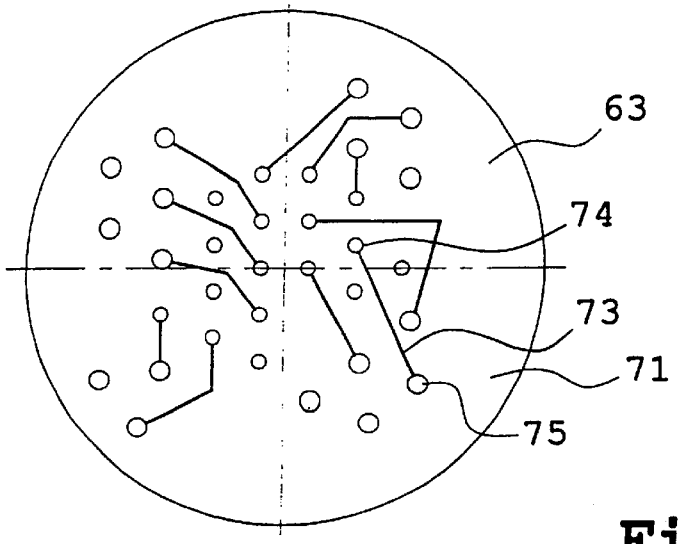
Figure 6C:
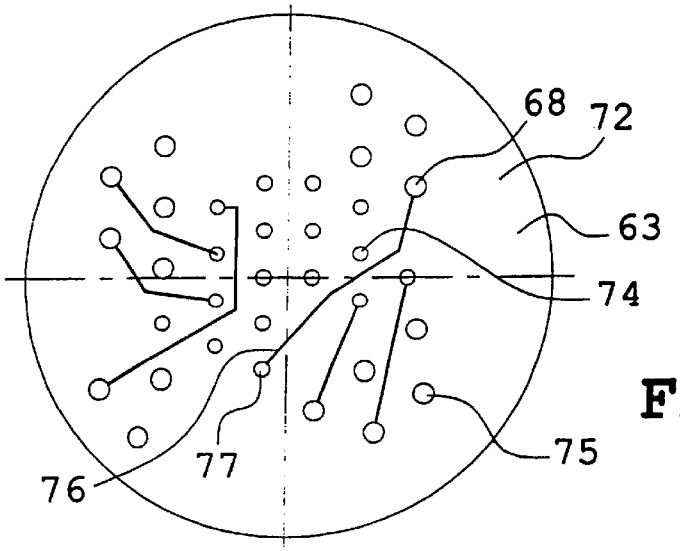

The printed board 63 has several conductive holes 70 like the hole 59. In the example shown in FIGS. 6A, 6B and 6C, the printed board 63 has conductive tracks, on a first surface 71 and on a second surface 72, each connecting a contact of a group with a conductive hole, like the hole 70. For instance, on the surface 71, a track 73 connects the hole 74, like the hole 70, to the contact to the powered 75 of the group 69. In another instance, on the surface 72, a track 76 connects a conductive hole 77, like the hole 70, to a contact to be powered 68 of the group 64. In this case, the track 73 intersects the track 76 but, since they are on two different surfaces, 71 and 72 respectively, they are not in contact.

The interest of the invention which proposes a multilayer printed board, is to allow the provision of a number of tracks following different paths, and being allowed to intersect, thanks to the fact that they are not situated on the same plane.

What is claimed is:

1. A connector which has a body, at least one power contact and at least one contact adapted to be powered, each of the contacts having a first end fitted in the body, wherein the power contact has an insulating surface and a conductive surface, and further wherein the contact to be powered has a conductive socket that slides along the contact to be powered, between a first position in which the socket is in contact with the insulating surface, and a second position in which the socket ensures connection with the conductive surface, whereby the connection established in the second position is conductive and allows powering of the contact to be powered by the power contact.

2. A connector as claimed in claim 1, wherein said insulating surface of said power contact comprises an insulating sleeve fitted around said power contact, said insulating sleeve having an undercut portion for retaining said socket in said first or high position.

3. A connector as claimed in claim 1, wherein said conductive surface of said power contact comprises a conductive sleeve fitted around said power contact, said conductive sleeve having an undercut for retaining said socket in said second or low position.

4. A connector as claimed in claim 1, wherein a socket of said contact to be powered comprises an insulating body and a conductive blade, to ensure connection between said contact to be powered and said power contact.

5. A connector as claimed in claim 1, wherein said socket of said contact to be powered is a conductive body having a projection adapted to come into contact with said power contact.

6. A connector as claimed in claim 1, wherein said contacts are disposed in receiving holes and include several contacts to be powered disposed around the central contact, so that the holes for receiving said contacts to be powered are at the same distance from the hole of said power contact and are disposed in an equilateral arrangement around the hole of said power contact.

7. A connector as claimed in claim 1, wherein said connector comprises several contacts to be powered around one of said power contacts so that a high or low position of a socket of said contact to be powered is independent of the relative positions of said sockets of said other contacts to be powered.

8. A connector as claimed in claim 1, wherein said connector includes six contacts to be powered, surrounding a power contact, so that sockets of these contacts to be powered are adjacent thereto.

9. A connector as claimed in claim 1, wherein said socket has a hexagonal cross section.

10. A connector as claimed in claim 1, wherein the end of said contact to be powered has a socket positioning mark along its axis, the mark being apparent when the socket is in said low position.

11. A connector as claimed in claim 1, wherein said connector includes a printed board having at least one power contact, one contact to be powered and a hole connected by an electric track to one of said contacts, so that the hole is disposed randomly on the printed board.

12. A connector as claimed in claim 11, wherein said printed board has several layers and tracks on each of these layers, connecting holes to contacts of said printed board.

* * * * *